US005813330A

United States Patent [19]

Newman

[11] Patent Number: 5,813,330

[45] Date of Patent: Sep. 29, 1998

[54] ADJUSTABLE FLEXIBILITY SQUEEGEE WITH REPLACEABLE CONTACT BLADE

[75] Inventor: Don E. Newman, Wyncote, Pa.

[73] Assignee: Stretch Devices, Inc., Philadelphia, Pa.

[21] Appl. No.: 662,561

[22] Filed: Jun. 10, 1996

[51] Int. Cl.[6] ..... B05C 17/04

[52] U.S. Cl. ..... 101/123; 101/169

[58] Field of Search ..... 101/114, 123, 101/124, 129, 154, 155, 161, 162, 167, 169, 157; 15/256.5, 256.51, 256.53

[56] References Cited

U.S. PATENT DOCUMENTS

| | | | |
|---|---|---|---|
| 3,788,219 | 1/1974 | Gallagher | 101/425 |
| 3,822,642 | 7/1974 | Grindeland | 101/425 |
| 3,908,293 | 9/1975 | Newman | 38/102.91 |
| 3,960,076 | 6/1976 | Wick | 101/119 |
| 3,998,157 | 12/1976 | Mitter | 101/120 |
| 4,078,486 | 3/1978 | Moser | 101/120 |
| 4,083,633 | 4/1978 | Shanly | 355/15 |
| 4,102,266 | 7/1978 | Porth | 101/124 |
| 4,107,812 | 8/1978 | Lantto | 15/245 |
| 4,254,709 | 3/1981 | Arnolds | 101/425 |
| 4,299,164 | 11/1981 | Jonkers | 101/120 |
| 4,329,936 | 5/1982 | Heist et al. | 101/124 |
| 4,345,390 | 8/1982 | Newman | 38/102 |
| 4,367,691 | 1/1983 | Bergs | 118/119 |
| 4,409,700 | 10/1983 | Sullivan | 15/121 |
| 4,525,909 | 7/1985 | Newman | 29/121.1 |
| 4,537,130 | 8/1985 | Theilacker | 101/425 |
| 4,586,212 | 5/1986 | Gasser | 15/256.51 |
| 4,716,616 | 1/1988 | Poon | 15/245 |
| 4,742,595 | 5/1988 | Isaacs | 15/105 |
| 4,989,512 | 2/1991 | Lindstrom | 101/123 |
| 5,001,979 | 3/1991 | Kurten | 101/123 |
| 5,152,221 | 10/1992 | Weeks | 101/157 |

FOREIGN PATENT DOCUMENTS

| | | | |
|---|---|---|---|
| 8301313 | 11/1984 | Netherlands . | |
| 630559 | 6/1982 | Switzerland | 101/123 |
| 1 215 200 | 11/1968 | United Kingdom . | |

*Primary Examiner*—Ren Yan

*Attorney, Agent, or Firm*—Seidel, Gonda, Lavorgna & Monaco, PC

[57] ABSTRACT

A squeegee for interacting with ink and a printing screen. The squeegee has a mounting head. The mounting head has an attachment portion and a blade mounting portion. A contact blade is received by the blade mounting portion of the mounting head and adapted for interacting with the screen and the ink.

15 Claims, 15 Drawing Sheets

ADJUSTABLE FLEXIBILITY SQUEEGEE WITH REPLACEABLE CONTACT BLADE

FIELD OF THE INVENTION

This invention relates to a squeegee for use in screen printing. More particularly, the present invention relates to a squeegee having a fixed cantilever length, a preselected bending response to forces exerted on the squeegee that is not affected by inks and solvents, and a replaceable contact blade or tip.

BACKGROUND OF THE INVENTION

Screen printing is accomplished by a squeegee being moved under pressure (force) across a screen mesh to deflect the screen downward into momentary contact with a substrate, and to force ink through orifices in the screen. The interaction between the screen mesh, the substrate, the ink, and the squeegee results in the ink contacting the substrate and the ink shearing from the screen mesh onto the substrate.

Screen printing is distinct from most other forms of printing in that it is an "off contact" form of printing. In contrast, lithographic, flexographic, rotograuve, and roto screen printing are forms of "on contact" printing in which the ink is transferred to the substrate by contact with a rotating drum or cylinder. Many of the problems overcome by the invention described herein do not exist in "on contact" printing because of the rigidity of the rotating drum employed in "on contact" printing.

In screen printing, it takes two steps to get the ink through the screen to the substrate. The first step is the placement of the ink across the screen mesh and into the orifices thereof. This step occurs prior to the deflection of the screen by the squeegee. This placement of the ink may be accomplished using a flood bar such as described in U.S. patent application Ser. No. 08/371,732, (filed on Jan. 12, 1995) assigned to the same assignee, and which is incorporated herein by reference. While the placement of the ink in the orifices of the screen mesh by the flood bar affects both the quality and the speed of printing, a detailed understanding of the workings of the flood bar is not required to fully comprehend the present invention. The flood bar will be discussed only briefly in the detailed description of the invention.

The relationship between the screen mesh, the substrate, the ink, and the squeegee is detailed more completely by further explaining the screen printing process. The screen mesh is positioned some distance above the substrate. Therefore, the screen is not in contact with the substrate. The distance between the screen and the substrate is defined as the off-contact distance. The position of the screen mesh relative to the substrate is not a random occurrence. Several factors influence the exact placement of the screen mesh above the substrate, (i.e., the off-contact distance) in order to achieve higher quality and faster operational speed. At this time, it is recognized that the most relevant factor is the tension of the screen mesh.

In recent years, the tension placed on the screen mesh has increased from approximately seven Newtons per centimeter to eighty-five Newtons per centimeter and higher. The development of higher screen tensions has permitted placement of the screen mesh in closer proximity to the substrate. Because of this higher tension and the closer placement of the screen mesh to the substrate, image distortion is virtually eliminated, interface friction and pressure between the screen mesh and the squeegee or flood bar in the flooding process is reduced, more uniform interface pressure is achieved between the squeegee and the screen mesh, as well as other benefits. One of the reasons that screen tension results in these benefits is that a more uniform pressure is required to deflect the screen and thus the amount of deflection (i.e., the off contact distance) required is reduced as explained in greater detail hereafter. Although the increased tension minimizes problems of non-uniform pressure, the interface pressures will likely never be uniform and there may always be an off contact distance.

The primary purpose of the squeegee is to deflect the screen mesh into contact with the substrate and to apply a downward hydraulic force onto the ink while allowing the tension of the screen mesh to snap the mesh away from the substrate, shearing the ink from the mesh, and thereby depositing the ink onto the substrate. Typically, the squeegee is shaped such that the engagement of a tip of the squeegee against the screen mesh is a line contact. The amount of force exerted by the tip of the squeegee against the screen mesh affects the deflection of the screen mesh. The force required to deflect the screen is dependent on the screen tension (see FIG. 4). The amount of force needed to deflect the screen mesh engaged by the squeegee is not uniform from the middle of the screen mesh to the edge of the screen mesh (or from the middle of the stroke to both the beginning and end of the stroke). The increased tension merely minimizes the problem.

The screen/squeegee interface affects the pressure the ink receives from the squeegee to force the ink through the screen mesh into contact with the printing substrate. Interface pressures, as well as squeegee speed, control the shear rate of the ink from the orifices of the mesh. While the screen mesh is in a position of being stretched downward to the substrate, the ink interface pressure exists in a dynamic state. As the squeegee moves forward, the screen mesh snaps up vertically, participating in the ink shear process. The hydraulic force on the ink is also controlled by the force of the squeegee pressing down. Therefore, the more consistent the squeegee is, the more reproducible the results.

Conventional squeegees are made of a polymeric material. The amount of force at the screen/squeegee interface is the result of the angle of the squeegee, the height or cantilever length of the squeegee, the material proprieties of the squeegee (such its durometer), and the amount of force exerted on the squeegee. The movement under pressure of the squeegee on the screen and the chemical reaction between the ink and the squeegee results in physical wear to the squeegee and change in the molecular properties of the squeegee, such as its durometer, its chemical (ink) resistance, and its elastic limit point. These changes result in variations in the screen/squeegee interface pressure during screen printing operation. The variations pressure result in variations in the ink delivery characteristics which can cause smudges and inconsistences in ink quality and quantity. Depending on the type of ink being used, the squeegee may have to be changed often (i.e., as much as every hour) to ensure proper quality.

While the squeegee may be ground to achieve a proper tip, this grinding must be precise. Grinding results in the height (also referred to as cantilever length) of the squeegee being reduced. The change in the height of the squeegee results in changes in the characteristics of the screen/squeegee interface. Since the stiffness of the squeegee is proportional to the cube of its height, a small change in length greatly affects the stiffness. Furthermore, grinding the tip does not remove the entire portion of the squeegee has had molecular properties degraded as the result of interaction with the ink.

It is desired to have a squeegee for interacting with ink and a printing screen wherein the forces at the screen/squeegee interface are held constant.

SUMMARY OF THE INVENTION

This invention is directed to a squeegee for interacting with ink and a printing screen. The squeegee has a mounting head. The mounting head has an attachment portion for receiving a force, and for receiving a blade mounting portion. A contact blade is received by the blade mounting portion of the mounting head and is adapted for interacting with the screen and the ink.

In a preferred embodiment, the mounting head has a depending tip having a straight uniform surface and edge, and the contact blade conforming to the straight uniform shape of the mounting head.

Other objects, features, and advantages of the present invention will become apparent to those skilled in the art upon reading the specification, drawings, and appended claims.

BRIEF DESCRIPTION OF THE DRAWINGS

For the purpose of illustrating the invention, there is shown in the drawings forms which are presently preferred; it being understood, however, that this invention is not limited to the precise arrangements and instrumentalities shown.

DETAILED DESCRIPTION OF THE INVENTION

Figure 1:
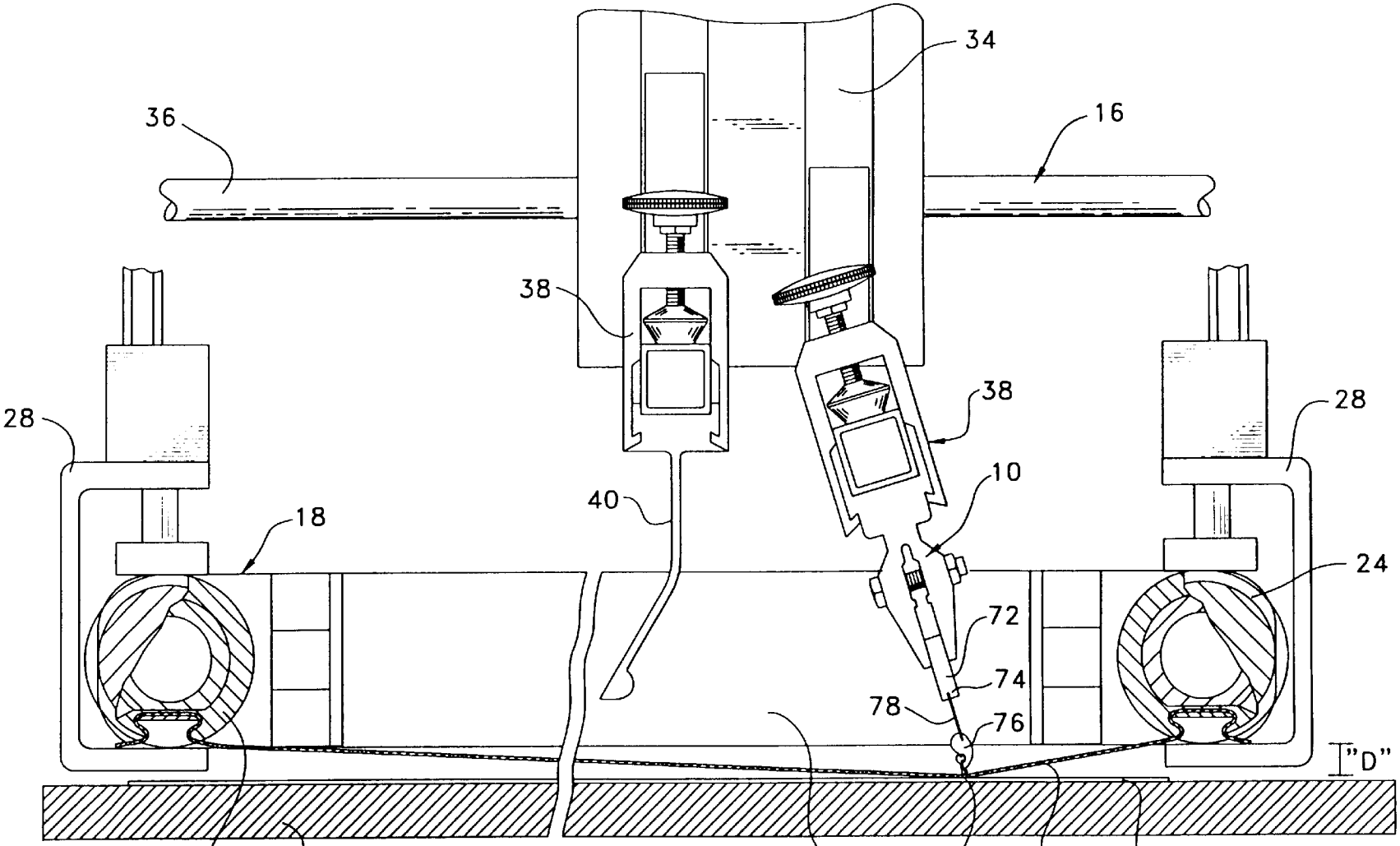
FIG. 1 is a sectional view of an automatic screen printing machine having a squeegee in accordance with the present invention.

Referring to the drawings, where like elements are identified by like numerals, there is shown in FIG. 1 an embodiment of a squeegee 10. Squeegee 10 in accordance with the present invention is provided for deflecting a screen mesh 14 and placing ink 12 (as seen in FIGS. 2 and 3) onto a substrate 32.

Referring to FIG. 1, a printing machine 16 has a tensioning frame 18 having four rollers (only three shown 20, 22, and 24) for holding the screen mesh 14 in tension. U.S. Pat. Nos. 3,908,293, 4,345,390, and 4,525,909 disclose such a tensioning frame device and are incorporated herein by reference. The tensioning frame 18 and screen mesh 14 are held in the printing machine 16 by a pair of clamps 28.

Figure 2:
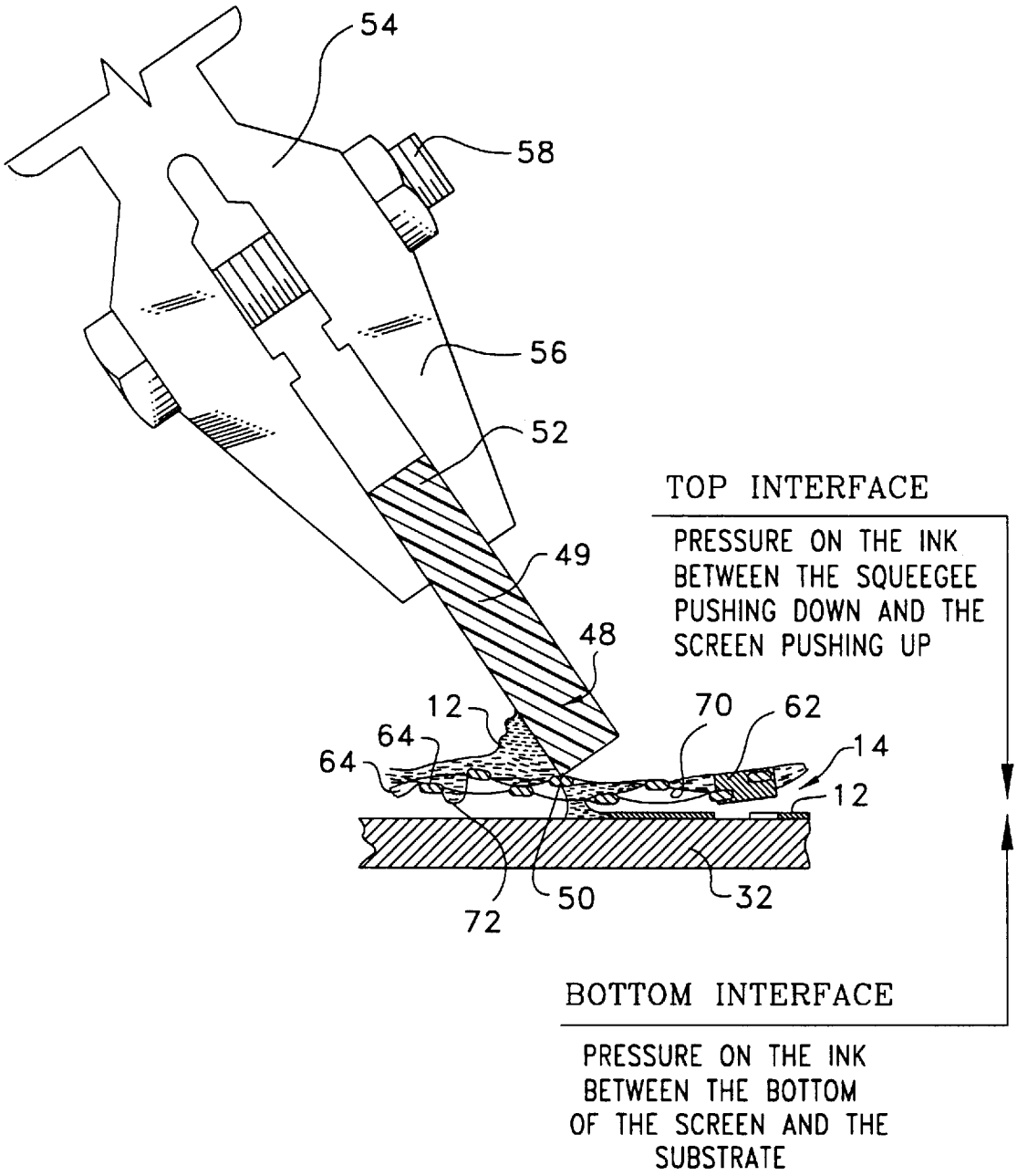
FIG. 2 PRIOR ART
FIG. 2 is an enlarged cross-sectional view of a prior art squeegee deflecting a screen mesh.
Figure 3:
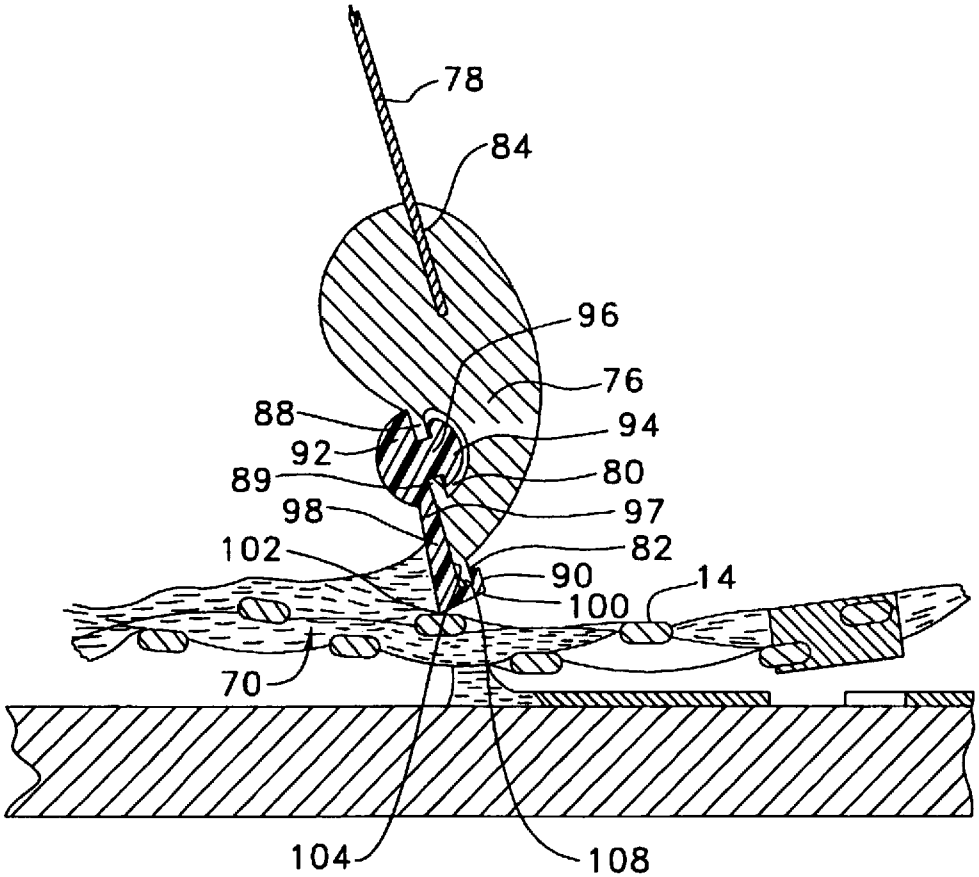
FIG. 3 is an enlarged cross-sectional view of a screen mesh with a squeegee in accordance with the present invention.

The printing machine 16 has a platform 30 on which lies the substrate 32 (e.g., a shirt, a poster, automotive parts, a bottle) that is to receive the ink 12 (FIGS. 2 and 3). The screen mesh 14 in the tensioning frame 18 is held by the clamps 28 a certain distance above the substrate 32. This distance between the screen mesh 14 and the substrate 32 is defined as an "off contact" distance "D".

The printing machine 16 has a head 34 which moves translationally along a pair of rails 36, only one shown, in a direction generally parallel to the screen mesh 14 and perpendicular to two of the rollers 20 and 24. The head 34 has a pair of mounting apparatus 38 for receiving the squeegee 10 and a flood bar 40, respectively.

Each mounting apparatus 38 has a pair of cylinders, not shown, which move the mounting apparatus between a lowered operational position and a raised position. In FIG. 1, the squeegee 10 is shown in the lowered operational position deflecting the screen mesh 14 into engagement with the substrate 32, the flood bar 40 is shown in the raised position.

As the head 34 moves translationally in one direction (to the right in FIG. 1) the flood bar 40, in lowered operational position (not shown lowered), places a flood coat layer 44 of the ink 12 over the screen mesh 14. On the return stroke, the flood bar 40 is moved to the raised position, as shown, and the squeegee 10 is lowered into contact with the screen mesh 14 and deflects the screen mesh 14 thereby depositing the ink 12 on the substrate 32.

Each of the mounting apparatus 38 has a limited pivotable adjustment means, not shown, for allowing adjustment of the angle of the flood bar 40 or squeegee 10 relative to the screen mesh 14. Even if the pivotable adjustment were not limited by the machine, the pivoting of the flood bar or squeegee is limited by the interference that would be created between the flood bar and the squeegee, between the flood bar or the squeegee and the edge of the screen (i.e., the roller), and by the print image.

Prior Art Squeegee

FIG. 2 shows a prior art squeegee 48 deflecting the screen mesh 14. The squeegee 48 has a shaft 49 and a tip 50 which engages the screen mesh 14. The tip 50 of the squeegee 48 deflects the screen into engagement with the substrate 32.

Prior to the squeegee 48 deflecting the screen mesh 14 and depositing the ink 12 onto the substrate 32, the ink 12 is placed in front of the squeegee by the flood bar. Referring back to FIG. 1, the flood bar 40 is moved across the screen mesh 14 to flood the screen mesh 14. Flooding the screen mesh 14 coats the screen mesh 14 with a uniform layer of ink 12. Depending on the type of flood bar 40 used, the ink either rests on top of the screen mesh 14 or is placed in the orifices 70 of the screen mesh 14. It is preferred that the ink 12 is placed into the orifices 70. U.S. patent application Ser. No. 08/371,732 (incorporated herein by reference) describes in greater detail the interaction of the flood bar and screen to place the ink into the orifices of the screen.

Examining the screen mesh 14 in more detail, the screen mesh is comprised of a series of threads 64 running in two directions perpendicular to each other. The threads 64 form openings or orifices 70 in the screen mesh 14. In order to appreciate what the flood bar 10 has to accomplish to fill the orifices, the size of the orifices in a typical screen mesh 14 will be examined. In a 305 conventional mesh screen having a thread diameter after weaving of approximately 47 microns at 0 Newtons/centimeter there are 93,025 orifices in a square inch since there are 305 threads per inch. When the tension is increased to approximately 40 Newtons/centimeter, there are approximately 78,400 orifices in a square inch due to the elongation of the screen mesh. Converting microns to inches and multiplying by the number of threads in an inch (280 after tensioning) yields the area taken by mesh. The remaining area is open. Dividing the open area by the number of openings in a linear inch results in the size of the opening. Each of the orifices is approximately 0.00172 inches by 0.00172 inches in size.

The inks used for screen printing have various material properties and viscosities and other rheological characteristics selected upon consideration of factors such as the substrate and the image to be printed. However, many inks typically have a consistency or viscosity ranging from that of warm molasses to that of cream cheese. Therefore, the ink is not going to flow into the very small orifices very easily.

Referring back to FIG. 2, the squeegee 48 of the prior art pushes the screen mesh 14 into contact with the substrate 32 and interface pressure between the squeegee and the screen mesh forces the ink into contact with the substrate. In addition, depending on the flood bar, the squeegee 48 is required to push the ink 12 through the orifices 70 of the screen mesh 14 concurrently with deflecting the screen mesh 14.

As can be seen in FIG. 2, a stencil 62 adhered to the screen mesh 14 defines the area where the ink 12 is placed (print image) onto the substrate. As the squeegee 48 moves over the screen mesh, deflecting the screen mesh 14, the screen mesh 14 behind the squeegee 48 snaps upward away from the substrate 32 creating a shearing force onto the ink relative to the surface area of the threads that define the open orifices of the mesh. The shearing force results in the deposition of the ink 12 onto the substrate 32. FIG. 2 shows the screen mesh 14 exaggeratedly spaced from the substrate 32 in order to show the elements. A squeegee 48 cannot successfully travel any faster than the time it takes the ink to first travel through the small orifices of the screen mesh, past the bottom of the stencil 62, to adhere to the substrate 32, and to pull/shear the ink 12 out of the orifices as the screen mesh snaps upward. If the squeegee travels too quickly either no image or a partial image will result on the substrate 32.

The orifices 70 behind the squeegee 48, shown to the right in FIG. 2, are partially filled. Depending upon the tension of the screen mesh 14, the type of ink 12 used, and the squeegee force and speed, the orifices could be either empty or only partially empty.

Figure 4:
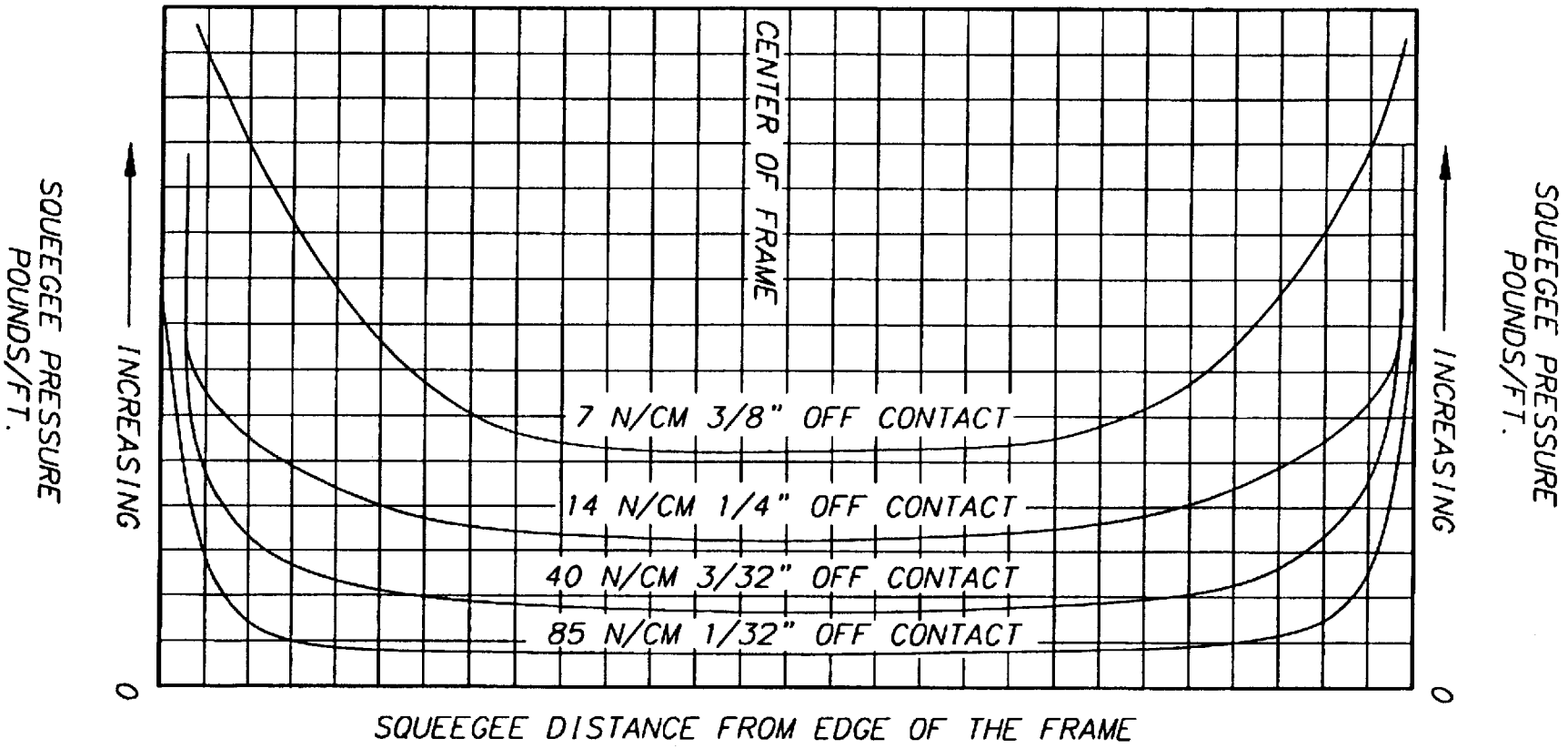
FIG. 4 (PRIOR ART)
FIG. 4 is a graph illustrating the off contact distance and the relationship between squeegee pressure in pounds per foot and the distance from the edge of the frame.

With reference to the interaction of the squeegee 10 with the screen mesh 14, the threads of the screen mesh in both directions act as a double cantilever wherein the deflection is related approximately to the cube (power of 3) of the distance from the roller (i.e., the end constraints). As the tension increases on the screen mesh 14, the off contact distance can be reduced since the deflection resulting from a force is more uniform across the screen mesh 14; more force is required to deflect the screen. The amount of force required to deflect the fabric is more uniform from the middle of the mesh to the outer edges of the image area as seen in FIG. 4. In addition the interface pressure is more uniform on the ink. However, while the force required and the interface pressure become more uniform, neither are ever completely uniform.

FIG. 4 shows a representation of the non-uniform pressure of the squeegee 10, 48 needed to make contact with the printing substrate 32 below. As indicated above, as the tension of the screen mesh 14 increases, the distance between the screen mesh 14 and the substrate can be reduced because the screen has a greater snap force to release itself from the ink/substrate adhesion. The curve tends to flatten out on the bottom portion indicating a more uniform interface pressure across the width of the screen and resulting in a more uniform ink deposit and shear force. This is one of the reasons why a higher tension screen is preferred. A second reason is lower off-contact distance produces less distortion of the transferred image— nearly a perfect one to one relationship.

As can be seen in FIG. 2, ink 12 is in contact with the squeegee 48. As the squeegee is used to deflect the screen mesh 14 and to push the ink 12, the ink 12 alters the material of the squeegee 48 as indicated in the Background of the Invention. Alteration of the squeegee 48 includes the swelling of the squeegee and the reduction of flexure rate and resiliency. Moreover, the compression set increases.

Additionally, the rubbing of the tip 50 of the squeegee 48 against the screen mesh 14 causes the tip 50 to wear away. The operator is required to re-grind the squeegee 48 to have a sharp tip 50. In grinding the squeegee 48, the height or cantilever length of the squeegee 48 is decreased. The decrease in distance from the tip 50 of the squeegee 48 to that of the mounting portion affects the characteristics of the squeegee 48, such as flexing by increasing the effective stiffness. For example, the reduction in length results in some of the same effects as using a higher durometer squeegee, such as raising the durometer of the squeegee from 60 to 85. A wearable tip 50 is desired to minimize damage to the screen mesh.

The squeegee 48 has a mounting portion 52 opposite the tip 50 for mounting in a bracket 54. The bracket has a pair of movable legs 56 having a threaded fastener 58 for compressing the legs 56 against the mounting portion 52 of the squeegee 48. The bracket 54 is received in the mounting apparatus 38 of the head 34 as shown in FIG. 1.

Preferred Embodiments of the Invention

Referring to FIG. 1, the squeegee 10 has a mounting head 72 and a flexible contact blade or tip 90. The mounting head 72 has an attachment bracket 74, a blade mounting bracket 76 (also referred to as tip mounting bracket) and an interposed resilient strip 78. The attachment bracket 74 is received by the bracket 54 in much the same way as in the prior art.

Referring to FIG. 3, the blade mounting bracket 76 has a tip retaining channel or groove 80, a downward depending protrusion or tip 82, and a groove 84 for receiving the resilient strip 78. Preferably, the resilient strip 78 is secured to both the blade mounting bracket 76 and the attachment bracket 74, as shown in FIG. 1, by the groove 84 and by the use of an adhesive. It is recognized that other methods of securing the resilient strip 78 can be used such as compression or stakes. Desirably, the tip receiving channel 80 has a curved surface. The blade mounting bracket 76 has a pair of legs 88 and 89 projecting into the channel 80 to form a female interlocking coupling. Preferably, the protrusion 82 is machined and/or precision extruded to have a straight uniform surface and edge, and the lower leg 89 which projects into the channel 80 is machined and/or precision extruded to have a straight uniform surface and edge.

The flexible contact blade 90 has a mounting portion 92 with a tab 94 received by the tip receiving channel 80. The tab 94 has a neck portion 96. The tab 94 of the flexible contact blade 90 is slid laterally into the tip retaining channel 80 of the blade mounting bracket 76. The legs 88 retain the tab 94 in the channel 80. As an alternative to sliding the contact blade 90 on, the contact blade 94 can also be rolled to compress the tab 94 into the channel 80.

The flexible contact blade 90 has an ink interaction portion 97. The ink interaction portion 97 has a side surface 98 and a bottom surface 100, which intersect at a printing edge 102. The edge 102 interacts with screen mesh 14. In addition, the flexible contact blade 90 has a pair of inner side surfaces 104 and an inner bottom surface 108. The inner surfaces 104 and 108 form a channel for receiving the bottom tip 82 of the blade mounting bracket 76. Preferably, the printing edge 102 is in close proximity to the bottom tip 82 of the blade mounting bracket 76 and therefore conforms to the shape of the bottom tip 82 and is straight and uniform. Furthermore, the top surface of the lower leg 89, which is parallel to the bottom tip 82, assists in pulling the flexible contact blade 90 snug against the bottom tip 82 of the blade mounting bracket 76.

In a preferred embodiment, the attachment bracket 74, the blade mounting bracket 76, and the resilient strip 78 are made of metal and are not affected by the properties of the ink. Desirably, the flexible contact blade 90 is an extruded plastic such as polyurethane, which is retained on the blade mounting bracket 76 by sliding the tab or male interlocking coupling 94 into the channel 80 with the neck 96 interposed between the legs 88. The channel formed by the inner side 104 and inner bottom 108 surfaces receive the bottom tip 92 retains the flexible contact blade 90 on the blade mounting bracket 76. The bottom tip 82 of the blade mounting bracket 76 ensures the straightness of the edge 102 of the flexible contact blade 90.

Still referring to FIG. 3, the edge 102 engages the screen mesh 14 deflecting the screen mesh 14 into engagement with the substrate 32. The screen mesh 14 is shown exaggeratedly spaced from the substrate in order to show the elements. The screen mesh 14 behind the squeegee 10 snaps up away from the substrate 32 resulting in the deposit of ink 12 on the substrate 32.

The flexible contact blade 90, as with the tip 50 of the prior art squeegee 48, wears away from rubbing with the screen mesh 14. However, in contrast to the tip 50 of the prior art squeegee 48, the flexible contact blade 90 can be replaced quickly and cheaply without affecting the cantilever length of the squeegee 10, thereby providing constant pressure and shear rate during the ink transfer.

In contrast to FIG. 2, FIG. 3 shows the ink 12 in front of the squeegee 10 filling the orifices 70. This distinction is the result of using a different flood bar such as disclosed in U.S. patent application Ser. No. 5,685,221.

Figure 3A:
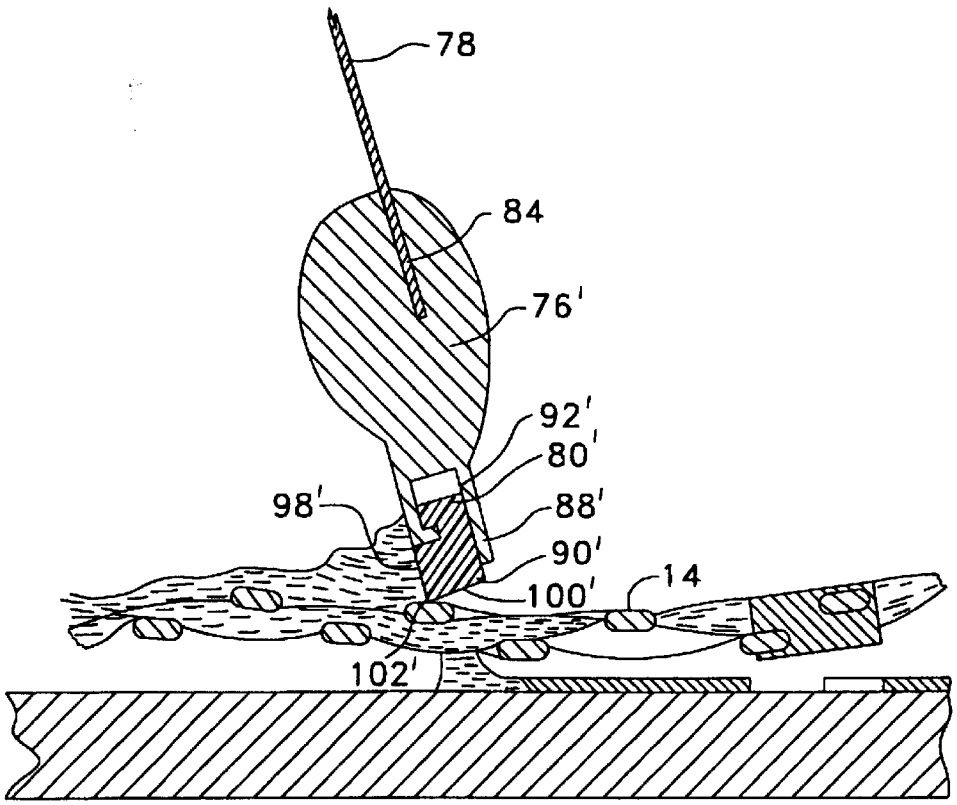
FIG. 3A is a figure similar to FIG. 3 showing a blade mounting bracket having an alternatively-shaped tip retaining channel for use with an alternatively-shaped flexible contact blade.

An alternatively-shaped tip retaining channel 80' of the blade mounting bracket 76' is shown in FIG. 3A. Similar to the blade mounting bracket 76 shown in FIG. 3, the blade mounting bracket 76' has a pair of legs 88' and 89'. However, only the front leg 89' projects into the channel 80'. The rear leg 88' acts as a stop to position the flexible contact blade 90'. The flexible contact blade 90' has a mounting portion 92' with a tab segment or male interlocking coupling 94' located above the inward projecting portion of the front leg 89' of the blade mounting bracket 76'.

The flexible contact blade 90' has an ink interaction portion 97'. The ink interaction portion 97' has a side surface 98' and a bottom surface 100', which intersects at a printing edge 102'. Similar to the edge 102 shown in FIG. 3, the edge 102' interacts with the screen mesh 14.

Figure 5:
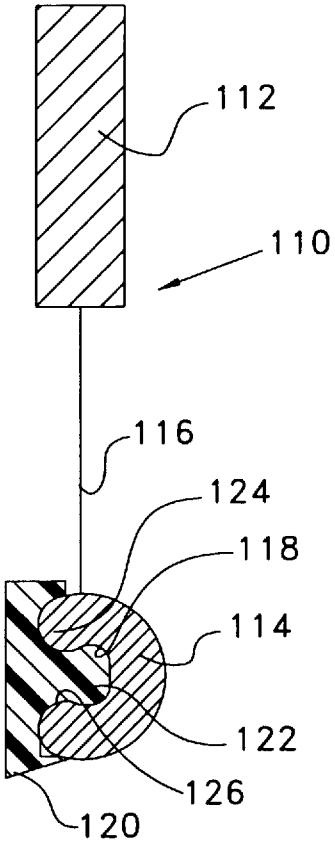
FIG. 5 is a cross-sectional view of a second embodiment of the squeegee.

Referring to FIG. 5, an alternative squeegee 110 is shown. The squeegee has an attachment or mounting bracket 112, a blade mounting bracket 114, and a resilient strip 116. In contrast to the first embodiment shown in FIGS. 1 and 3, with the squeegee 110 the resilient strip 116 is secured to both the stationary bracket 112 and the blade mounting bracket 114 preferably by a laser or electron beam weld. The shape of the blade mounting bracket 114 is substantially different from the first embodiment. This change is necessitated by cost and material constraints associated with the technology as of the filing of this application. This shape is most cost effective for a material that can withstand laser welding or other non-distorting welding technique. Desirably, the blade mounting bracket 114 and the resilient strip 116 are of a high temper spring steel or stainless steel.

The squeegee 110 has a replaceable tip 120 having a tab 122. The tab 122 is received by a channel 118 formed in the blade mounting bracket 114. The blade mounting bracket 114 has a pair of projections 124 which narrow the opening of the channel 118 to secure a neck 126 of the replaceable tip 120. The blade mounting bracket 114 does not have a bottom tip because of manufacturing constraints including cost as of the time of filing. However, it is recognized that the blade mounting bracket 114 could be made to have a bottom tip and channel similar to the first embodiment with increased manufacturing cost.

Figure 6A:
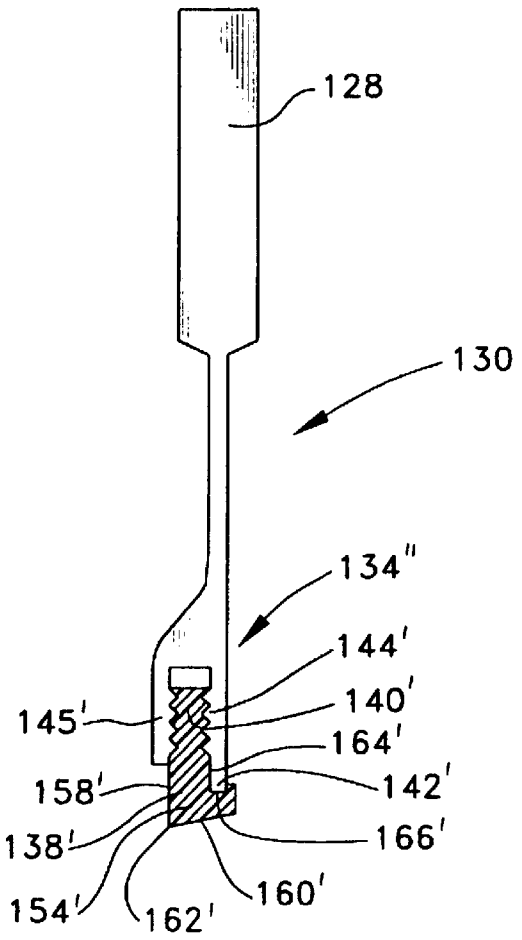
FIG. 6A is a figure similar to FIG. 6 showing a blade mounting bracket having an alternatively-shaped tip retaining channel for use with an alternatively-shaped flexible contact blade.
Figure 6:
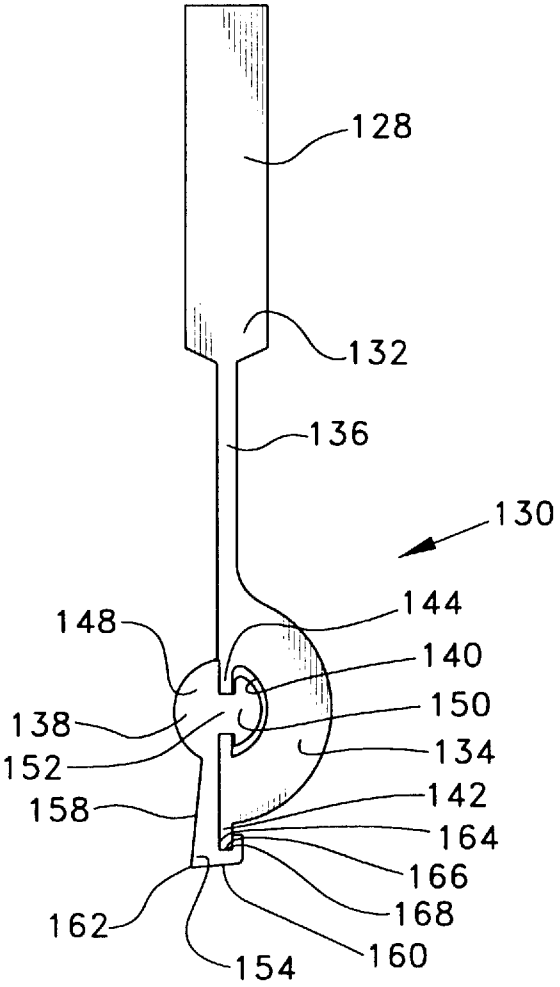
FIG. 6 is a cross-sectional view of a third embodiment of the squeegee.

Referring to FIG. 6, a third embodiment of the squeegee of the present invention is shown. This squeegee 130 has a mounting head 128 and a flexible contact blade 138. The mounting head 128 has an attachment portion 132, a blade mounting portion 134 (also referred to as tip mounting portion), and a narrow strip portion 136. Preferably, the narrow strip portion 136 is integral with the attachment portion 132 and the blade mounting portion 134.

Similar to the blade mounting portion of the first embodiment, the blade mounting portion 134 has a tip retaining channel or groove 140, and a downward depending protrusion or tip 142. The tip receiving channel 140 has a curved surface. The blade mounting portion 134 has a pair of legs 144 and 145 projecting into the channel 140. The top surface of the lower leg 145, which is parallel to the protrusion 142, assists in pulling the flexible contact blade 138 snug against the protrusion 142 of the blade mounting portion 134.

The flexible contact blade 138 of the squeegee 130 has a mounting portion 148 with a tab 150 received by the tip retaining channel 140. The tab 150 of the flexible contact blade 138 has a neck portion 152. The flexible contact blade 138 has an ink interaction portion 154. The ink interaction portion 154 has a side surface 158 and a bottom surface 160 which intersect at an edge 162. The edge 162 interacts with the screen mesh 12. In addition, the ink interaction portion 154 of the flexible contact blade 148 has a pair of inner side surfaces 164 and an inner bottom surface 166 for receiving the protrusion 142 of the blade mounting portion 134. The inner surfaces 164 and 166 form a channel 168.

Referring to FIG. 6A, an alternatively-shaped tip retaining channel 140' of a blade mounting portion 134' is shown. The blade mounting portion 134' has a pair of legs 144' and 145'. Each of the legs 144' and 145' has a series of protrusions projecting into the tip retaining channel 140'. The squeegee 130' has a flexible contact blade 138' having a mounting portion 148' which is received between the pair of legs 144' and 145' and is held in place by the protrusions. The flexible contact blade 138' has an ink interaction portion 154' with a side surface 158' and a bottom surface 160'. The side surface 158' and bottom surface 160' intersect at an edge 162' which interacts with a screen mesh, not shown. In addition, the ink interaction portion 154' has a pair of inside surfaces 164' and an inner bottom surface 166' for receiving the bottom portion 142' of the rear leg 144' of the blade mounting portion 134'.

Figure 8:
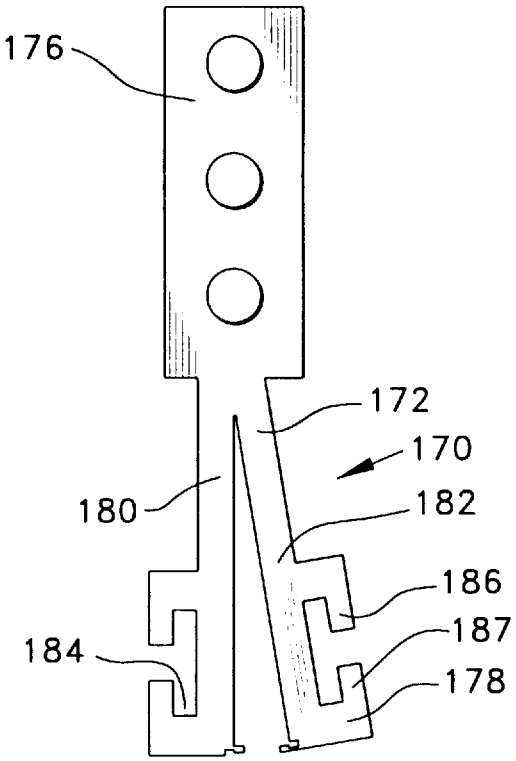
FIG. 8 is a cross-sectional view of the two halves of blade mounted portions of the squeegee which were shown in FIG. 7 separated joined.
Figure 7A:
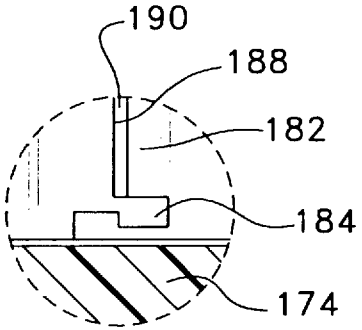
FIG. 7A is an enlarged view as shown in FIG. 7 of a locking mechanism in the squeegee of the fourth embodiment.
Figure 7:
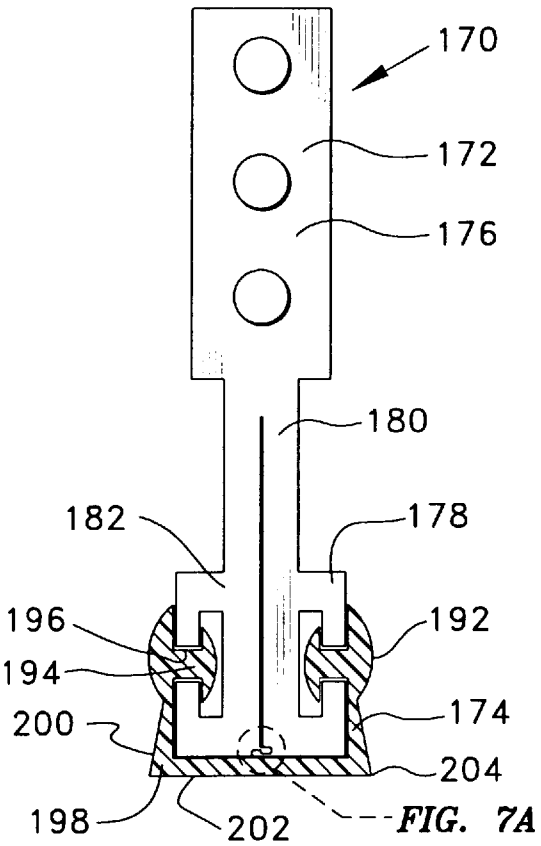
FIG. 7 is a cross-sectional view of a fourth embodiment of the squeegee.

Referring to FIGS. 7 and 8, a fourth embodiment of the squeegee according to the invention is shown. This squeegee 170 has a mounting head 172 and a flexible contact blade 174. The mounting head 172 in a preferred embodiment is formed of an extruded plastic. The mounting head 172 has an attachment portion 176, a blade mounting portion 178, and an interposed narrowed resilient portion 180. The narrowed resilient portion 180 and the blade mounting portion 178 are formed in two sections, shown in an open manufacturing position in FIG. 8. Each half 182 of the blade mounting portion 178 has a tip retaining channel or groove 184. In contrast to previous embodiments, the tip retaining channels 184 each have a square shape.

The blade mounting portion 178 has a pair of legs 186 and 187 projecting into each of the channels 184. As in previous embodiments, the top surface of the lower leg 187 which projects into the tip retaining channels 184 is machined and/or precision extruded to have a straight uniform surface and edge. The lower leg assists in pulling the flexible contact blade 174 into proper position as discussed in previous embodiments.

Each of the halves 182 of the blade mounting portion 178 has a detent 184, as best seen in FIG. 7A which interlocks to secure the two halves 182 together. The two halves 182 when joined together in a closed operational position form a slot 188. The slot 188 receives a resilient strip 190 to give the squeegee 170 a consistent resilient flexibility. In a preferred embodiment, the resilient strip 190 is a spring steel.

The flexible contact blade 174 of the squeegee 170 has a pair of mounting portions 192. Each mounting portion 192 has a tab 194 to be received by one of the tip retaining channels 184. The tab 194 has a neck portion 196 which is interposed between the legs 186 and 187 of the blade mounting portion 178 of the mounting head 172. The flexible contact blade 174 has an ink interaction portion 198. The ink interaction portion 198 has a pair of side surfaces 200 and a bottom surface 202. The bottom surface 202 intersects with each of the side surfaces 200 to form an edge 204 at each intersection. Either edge 204 can interact with a screen mesh 12.

Figure 9:
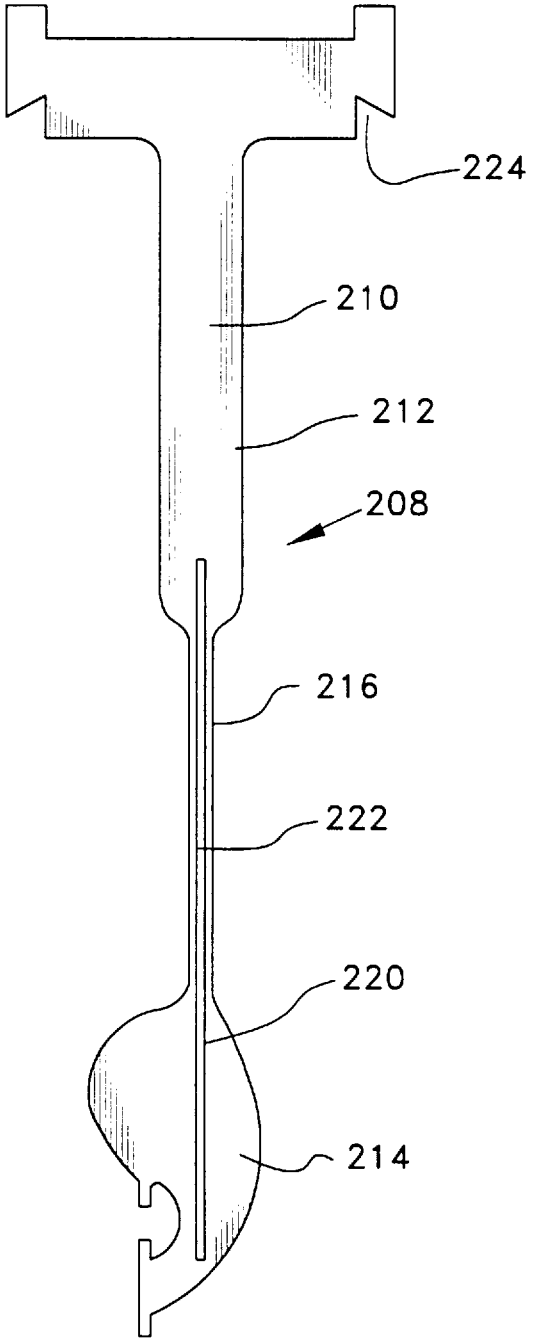
FIG. 9 is a cross-sectional view of a fifth embodiment of the squeegee having an alternative mounting portion. No replaceable contact blade or tip is shown.

Referring to FIG. 9, a fifth embodiment of the squeegee of the invention is shown. At the time of filing, this embodiment is the preferred embodiment of the inventor. However, this embodiment is expensive to produce. Therefore, other embodiments may be preferable from a commercial standpoint. This squeegee 208 has a mounting head 210. In operation, the squeegee 208 has a flexible contact blade (not shown). The flexible contact blade may be similar to that shown in FIGS. 1, 3, and 6 and in other embodiments which follow. The mounting head 210 has an attachment portion 212, a blade mounting portion 214, also referred to as a tip mounting portion, and an interposed resilient strip portion 216. In a preferred embodiment, the mounting head 210 is an extruded flexible plastic which is creep resistant and solvent resistant, such as polypropylene, nylon, or polyester. The mounting head 210 has a slot 220 extending from the attachment portion 212 to the blade mounting portion 214 through the entire narrow strip portion 216.

The mounting head 210 has a resilient strip 222 located in the slot 220 to give the squeegee 208 a consistent resilient flexibility. In a preferred embodiment, the resilient strip 222 is a piece of spring steel that is co-extruded into the slot 220 as the mounting head 210 is extruded.

The blade mounting portion 214 has a configuration similar to that of the first and third embodiments of the present invention. The blade mounting portion 214 forms a tip retaining channel and has a downward depending protrusion. A pair of legs of the blade mounting portion 214 project into the channel.

The attachment portion 212 of the mounting head 210 has a pair of grooves 224 to receive the mounting apparatus 38, as shown in FIG. 1. This attachment portion 212 is similar to that associated with the flood bars as disclosed in U.S. Pat. No. 5,685,221. In contrast to the previously disclosed embodiments, this embodiment does not require a bracket 54 as shown in FIG. 2. It is recognized that other embodiments could have attachment portions similar to this embodiment or vice-versa.

Figure 11:
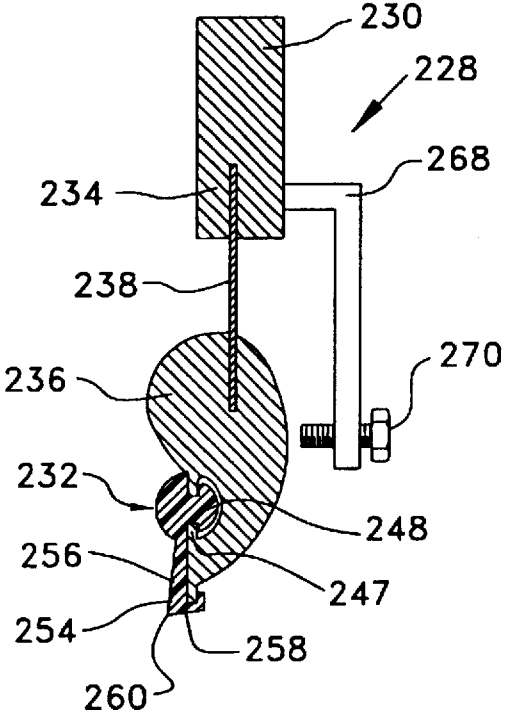
FIG. 11 is a cross-sectional view of the sixth embodiment of the squeegee.
Figure 10:
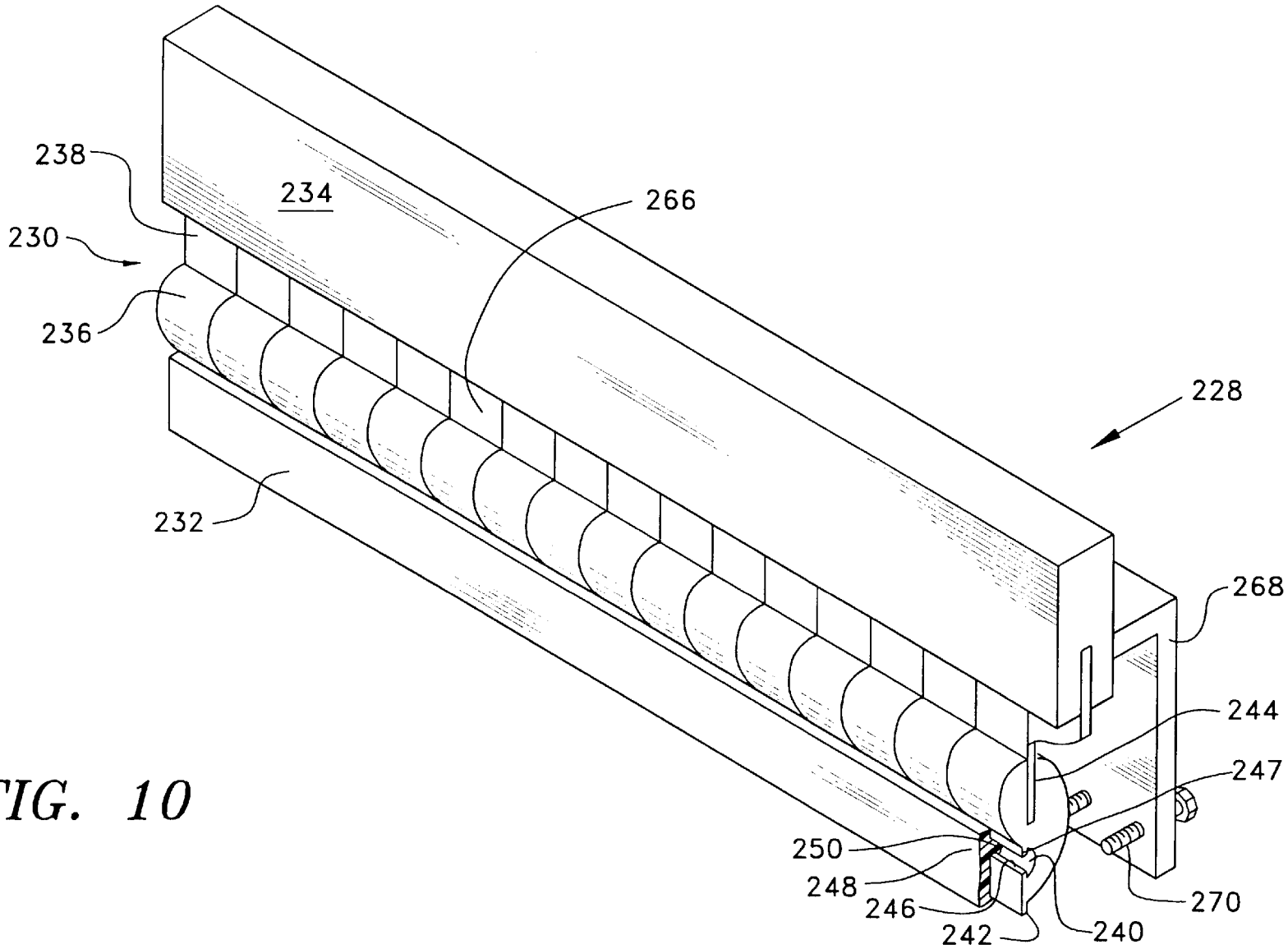
FIG. 10 is a perspective view of a sixth embodiment of the squeegee.

Referring to FIGS. 10 and 11, an alternative embodiment of the squeegee of the invention is shown. This squeegee 228 has a mounting head 230 and a flexible contact blade 232. The mounting head 230 has an attachment bracket 234, a blade mounting bracket 236, and a resilient strip 238. The blade mounting bracket 236 has a tip retaining channel or groove 240 and a downward depending protrusion or tip 242. In addition, the blade mounting bracket 236 has a groove 244 for receiving the resilient strip 238. The blade mounting bracket 236 has a pair of legs 246 and 247 projecting into the channel 240 for retaining the flexible contact blade 232. The lower leg 247 which projects into the channel 240 is preferably machined and/or precision extruded to have a straight uniform surface and edge. The top surface of the lower leg 247, which is parallel to the downward depending protrusion 242, assists in pulling the flexible contact blade 232 snug against the downward depending protrusion 242 of the blade mounting brackets 236.

The flexible contact blade 232 has a mounting portion 248. A tab 250 of the mounting portion 248 is received by the tip retaining channel 240. The tab 250 has a neck portion 252 that interacts with the legs 246 of the blade mounting bracket 236 for retaining the tab 250 in the tip retaining channel 240.

The flexible contact blade 232 has an ink interaction portion 254. The ink interaction portion 254 has a side surface 256 and a bottom surface 258, which intersect at an edge 260. The edge 260 interacts with the screen mesh 12. The squeegee 228 as described to this point is similar to several of the embodiments previously described. The flexible contact blade 232 likewise has a pair of inner side surfaces and an inner bottom surface to form a channel for receiving the downward depending protrusion 242 of the blade mounting bracket 236. The tab 250 of the flexible contact blade 232 is slid laterally into the tip retaining channel 240 of the blade mounting bracket 236 for securing the flexible contact blade 232 to the blade mounting bracket 236. A similar way of doing this was described with respect to the first embodiment.

In contrast to the previous embodiments, the blade mounting bracket 236 and the resilient strip 238 of the mounting head 230 are each divided into a plurality of segments 266. The attachment bracket 234 is a single piece. Each of the segments 266 of the resilient strip 238 are mounted to the single attachment bracket 234. The mounting head 230 preferably has an "L" shaped arm 268 mounted to or integral with the attachment bracket 234. The "L"-shaped arm 268 depends downward in proximity to the blade mounting bracket 236. The depending arm 268 has a plurality of adjustable fasteners 270 which project towards the blade mounting bracket 236. The amount of flexure of the blade mounting bracket 236 and the flexible contact blade 232 can be adjusted by adjusting the fasteners 270, such as screws, therein varying the placement or movement of the blade mounting bracket 236. The flexible contact blade 232 extends through the channel 238 of each of the blade mounting brackets. The flexible contact blade 232 is held in place to the blade mounting bracket 236 by the tab 250/tip retaining channel 240 interface and the downward depending tip 242/channel interface. The amount of flexure of the resilient strip 236 can be adjusted by varying the placement of the fastener which extends from the depending lip of the mounting bracket.

The squeegee 228 can be adjusted in total or in portions to improve sharpness of the image, color balance, ink density, etc. Individual segments can be adjusted for high or low spots. It is recognized that this embodiment is typically more difficult to clean after use, because of the likelihood of ink getting between the segments.

Figure 12:
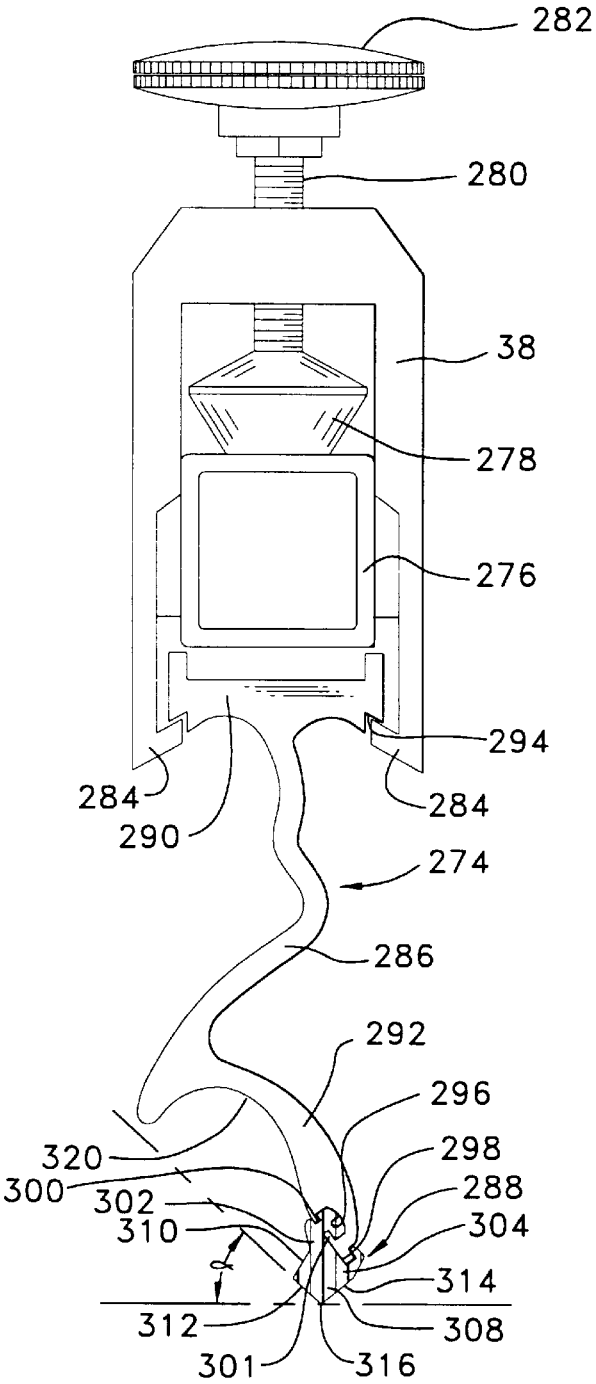
FIG. 12 is a cross-sectional view of a seventh embodiment of the squeegee.

Referring to FIG. 12, an alternate embodiment of the squeegee of the present invention is shown in a mounting apparatus 38 similar to that shown in FIG. 1. The mounting apparatus 38 has a hollow rectangular tube 276 which is engaged by a movable jaw 278. The movable jaw 278 is moved upward and downward by rotation of a threaded shaft 280 which passes through the mounting apparatus bracket. A handle 282 located on the threaded shaft 280 on the end opposite the jaw 278 facilitates the rotation. The mounting apparatus 38 has a pair of projecting fingers 284.

The squeegee 274 has a mounting head 286 and a flexible contact blade 288. The mounting head 286 has an attachment portion 290 and a blade mounting portion 292. The attachment portion 290 of the mounting head 286 has a pair of grooves 294 which are received by the projecting fingers 284 of the mounting apparatus 38. The blade mounting portion 292 has a configuration similar to that of several of the previous embodiments. The blade mounting portion 292 forms a tip retaining channel 296 and has a downward depending protrusion 298. A pair of legs 300 and 301 of the blade mounting portion 292 projects into the channel 296.

While the attachment portion 290 is known in the art, the benefit of using such an attachment portion on the squeegee 274 is that it eliminates the need for inner additional and opposing parts and the threaded fasteners provided approximately every 4" (as in the embodiments shown in FIGS. 1 and 2). One benefit of such attachment is the speed upon which the squeegee can be replaced in the printing machine.

The flexible contact blade 288 has a mounting portion 302 and an ink interaction portion 304. The mounting portion 302 of the flexible contact blade 288 has a tab 306 which is received by the tip retaining channel 296 of the blade mounting portion 292 of the mounting head 286. The tab 306 has a neck portion that interacts with the legs 300 and 301 of the blade mounting portion 292 as in several of the other previous embodiments. The ink interaction portion 304 has a top surface 310, a side surface 312, and a bottom surface 314. Similar to the previous embodiments, the side surface 312 and the bottom surface 314 intersect at an edge 316 wherein the edge 316 interacts with the screen mesh 12. The ink interaction portion 304 of the flexible contact blade 288 is positioned such that the top surface of the lower leg 301 and the depending protrusion 298, preferably having a machined and/or precision extruded uniform surface and edge, properly position the printing edge 316 of the ink interaction portion 304 of the flexible contact blade 288.

In addition, the squeegee 274 has an ink interaction surface 320 on the mounting head 286 located just above the blade mounting portion 292. The ink interaction surface 320 retains the ink in front of the flexible contact blade 288. The ink interaction surface 320 captures the ink and creates a forward rotation in the ink moving the ink in the front of the squeegee in a linear direction parallel to the direction in which the squeegee is moving.

Figure 13:
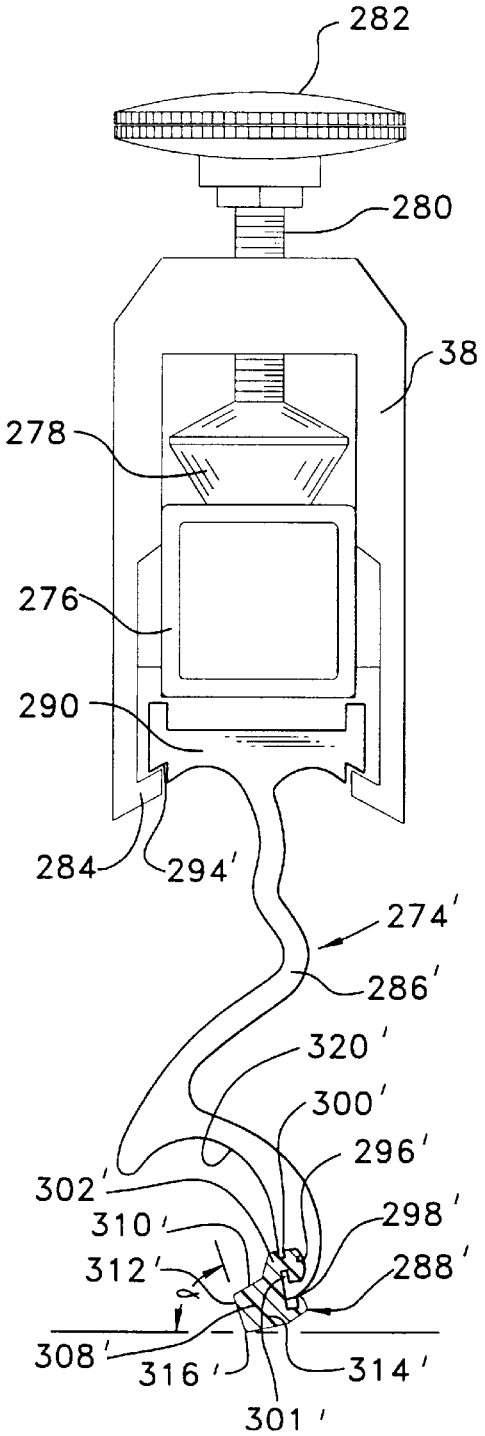
FIG. 13 is a cross-sectional view of an eighth embodiment of the squeegee.

Referring to FIG. 13, an alternate embodiment of the squeegee of the invention is shown in a mounting apparatus 38 similar to that shown in FIG. 1. The mounting apparatus 38 has a hollow rectangular tube 276 which is engaged by a movable jaw 278. The movable jaw 278 is moved upward and downward by rotation of a threaded shaft 280 which passes through the mounting apparatus bracket. A handle 282 located on the threaded shaft 280 on the end opposite the jaw 278 facilitates the rotation. The mounting apparatus 38 has a pair of projecting fingers 284'.

The squeegee 274' has a mounting head 286' and a flexible contact blade 288'. The mounting head 286' has an attachment portion 290' and a blade mounting portion 292'. The attachment portion 290' of the mounting head 286' has a pair of grooves 294' which are received by the projecting fingers 284' of the mounting apparatus 38. The blade mounting portion 292' has a configuration similar to that of several of the previous embodiments. The blade mounting portion 292' forms a tip retaining channel 296' and has a downward depending protrusion 298'. A pair of legs 300' of the blade mounting portion 292' projects into the channel 296'.

The flexible contact blade 288' has a mounting portion 302' and an ink interaction portion 304'. The mounting portion 302' of the flexible contact blade 288' has a tab 306' which is received by the tip retaining channel 296'. The tab 306' has a neck portion that interacts with the legs 300' and 301' of the blade mounting portion 292' as several of the other previous embodiments. The ink interaction portion 304', similar to the embodiment shown in FIG. 12, has a top surface 310', a side surface 312', and a bottom surface 314'. The side surface 312' and the bottom surface 314' intersect at an edge 316' which interacts with the screen mesh 12'. The top surface of the lower leg 301' and the depending protrusion 298', preferably having a machined and/or precision extruded uniform surface and edge, properly position the printing edge 316' of the ink interaction portion 304' of the flexible contact blade 288'.

The squeegee 274' has an ink interaction surface 320' on the mounting head 286' located just above the blade mounting portion 292'. The ink interaction surface 320' retains the ink in front of the flexible contact blade 288'.

A distinction between the embodiment and the previous embodiment resides in the angle of the blade mounting portion 292 relative to the attachment portion 290' and thus the flexible contact blade 288'. While the mounting apparatus 38 can be adjusted relative to the head 34 and the screen mesh 14, the side surface 312 and 312' forms an angle $\alpha$ of approximately 45° and 72° , respectively, to the screen mesh 14 shown in phantom.

Figure 12A:
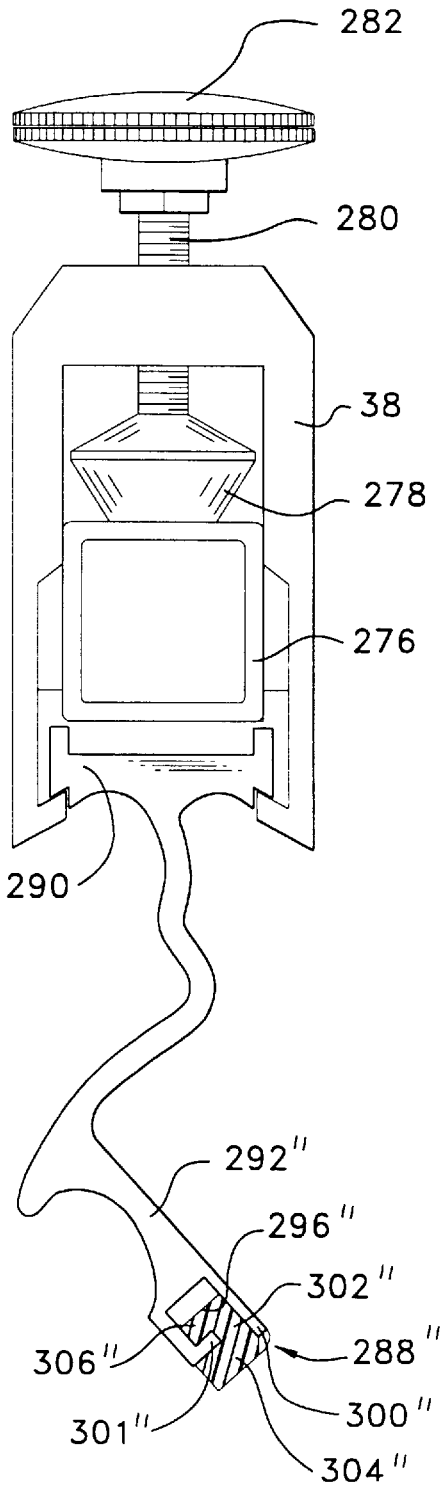
FIG. 12A is a figure similar to FIG. 12 showing a blade mounting portion having an alternatively-shaped tip retaining channel for use with an alternatively shaped flexible contact blade.
Figure 13A:
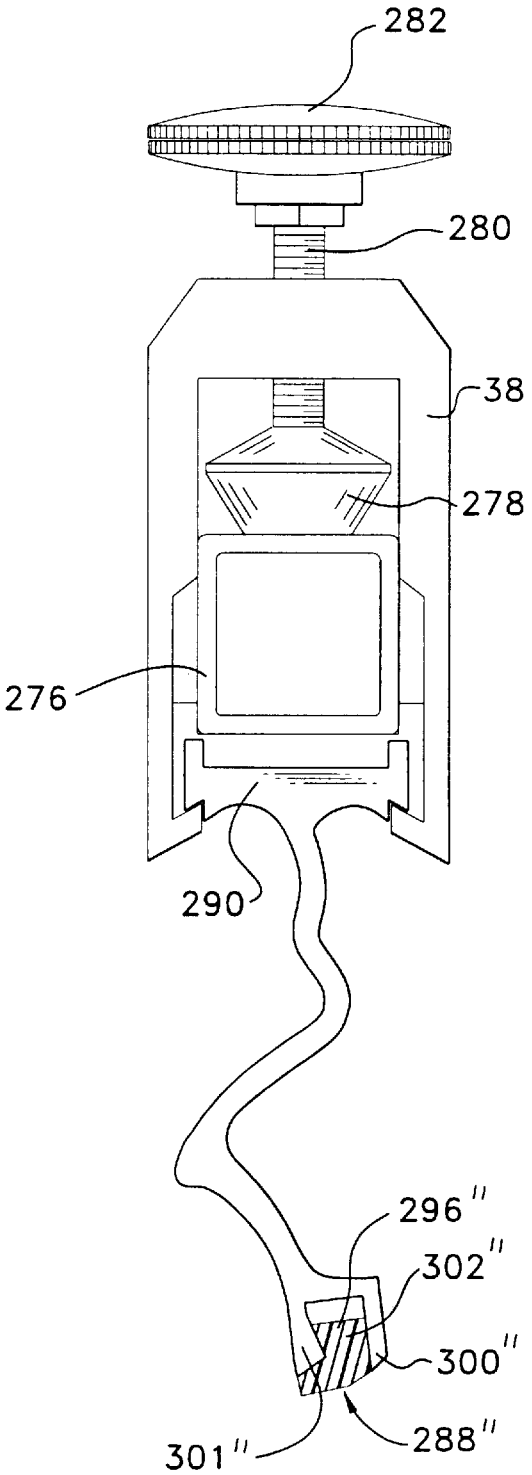
FIG. 13A is a figure similar to FIG. 13 showing a blade mounting portion having an alternative shaped tip retaining channel for use with an alternatively-shaped flexible contact blade.

Referring to FIGS. 12A and 13A, alternatively-shaped tip retaining channels 296" of the blade mounting portions 292" are shown. The blade mounting portions 292" each have a pair of legs 300" and 301". The flexible contact blade 288" has an ink interaction portion 304".

In FIG. 12A (similar to FIG. 3A), the front leg 301" projects into the channel 296". The rear leg 300" acts as a stop to position the flexible contact blade 288". The flexible contact blade 288" has a mounting portion 302" with a tab segment 306" located above the inward projecting portion of the front leg 301".

In FIG. 13A, the front leg 301" projects into the channel 296" at an angle. The rear leg 300" acts as a stop to position the flexible contact blade 288". The flexible contact blade 288" has a mounting portion 302" which widens as it projects into the closed end of the channel 296".

Figure 14:
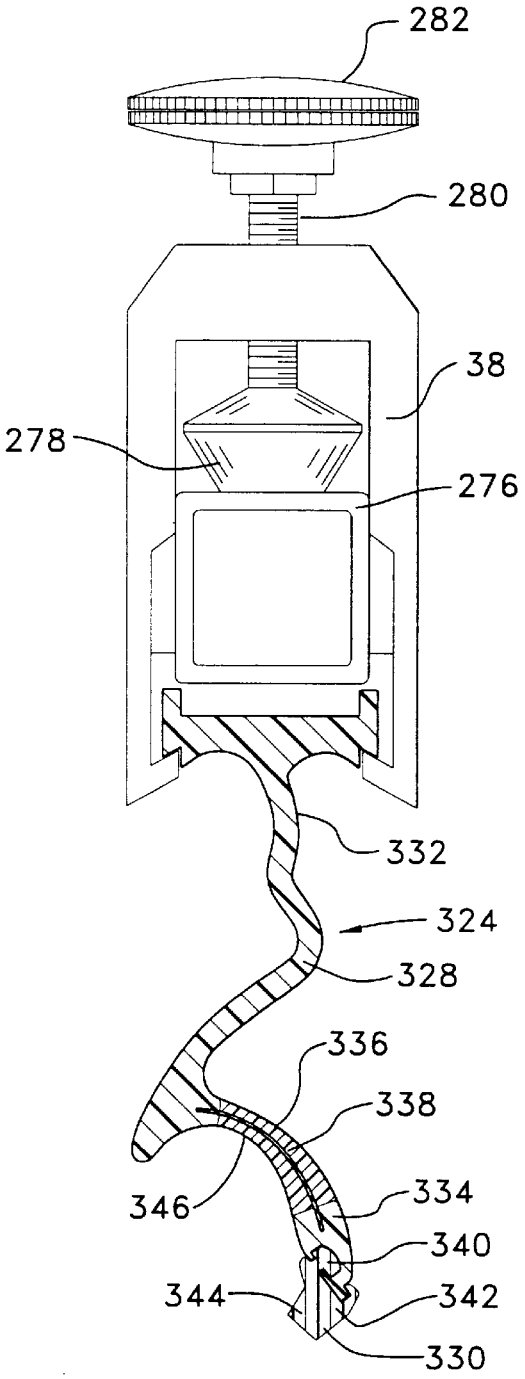
FIG. 14 is a cross-sectional view of a ninth embodiment of the squeegee.
Figure 15:
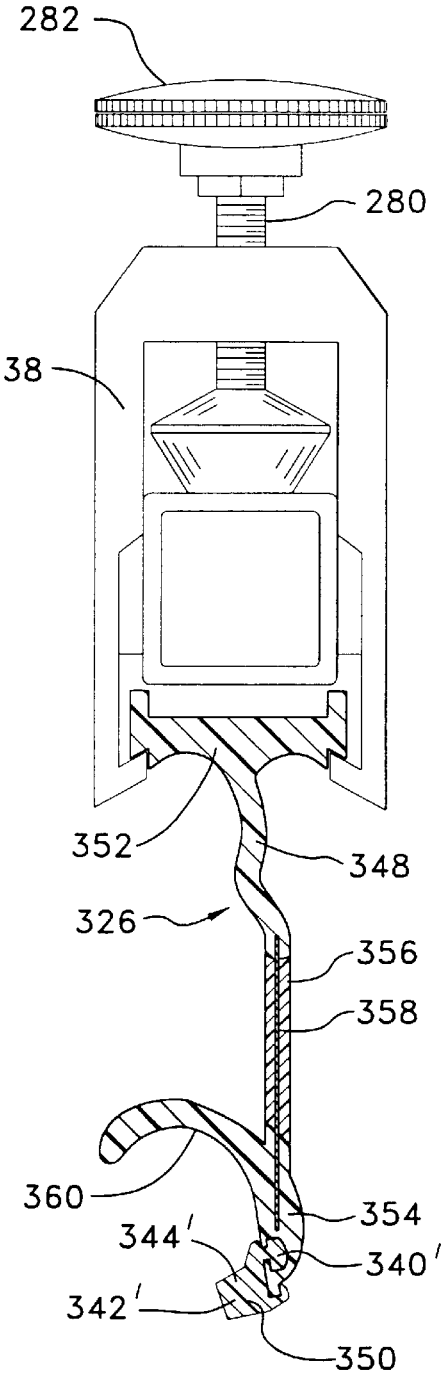
FIG. 15 is a cross-sectional view of a tenth embodiment of the squeegee.

Referring to FIGS. 14 and 15, alternative embodiments of squeegee 324 and 326 are shown, respectively. Similar to FIGS. 12 and 13, the mounting apparatus 38 has a hollow rectangular tube 276 which is engaged by a movable jaw 278. The movable jaw 278 is moved upward and downward by rotation of a threaded shaft 280. A handle 282 located on the threaded shaft 280 on the end opposite the jaw 278 facilitates the rotation. In contrast to the squeegees 274 and 274' (shown in FIGS. 12 and 13, respectively), which have a mounting head 286 in a preferred embodiment which is composed of aluminum or aluminum alloy and has generally the same thickness and a constant flexure rate throughout the entire mounting head, the squeegees 324 and 326 have portions with different flexure rates.

The squeegee 324 in FIG. 14 has a mounting head 328 and a flexible contact blade 330. The mounting head 328 has an attachment portion 332, a blade mounting portion 334, and a resilient portion 336. The mounting head, in a preferred embodiment is formed of a dual durometer plastic. The attachment portion 332 and the blade mounting portion 334 are formed of a more rigid or higher durometer material, such as vinyl or polyurethane. The resilient portion 336 is formed of a lower durometer or more flexible material, such as thermoplastic elastomer. In addition, the mounting head 328 has a resilient strip 338 extending between the attachment portion 332 and the blade mounting portion 334 through the resilient portion 336. The resilient strip 338 in a preferred embodiment is a piece of spring steel which is coextruded with the dual durometer plastic.

The blade mounting portion 334 has a configuration similar to that of the embodiment shown in FIG. 12. The blade mounting portion 334 forms a tip retaining channel and has a downward depending protrusion. The blade mounting portion has a pair of legs projecting into the channel. The flexible contact blade 330 is identical to that disclosed in FIG. 12 and has a mounting portion 340 and an ink interaction portion 342.

The squeegee 324 has an ink interaction surface 346 on the mounting head 328 (located above the flexible contact blade 330) consisting of portions of the attachment portion 332, the resilient portion 336, and the blade mounting portion 334. The ink interaction surface 346 retains the ink in front of the flexible contact blade 330.

The squeegee 326 in FIG. 15, similar to that in FIG. 14, has a mounting head 348 and a flexible contact blade 350. The mounting head 348 has an attachment portion 352, a blade mounting portion 354, and a resilient portion 356. In a preferred embodiment, the mounting head 348 is formed of a dual durometer plastic. The attachment portion 352 and the blade mounting portion 354 are formed of a more rigid or higher durometer material. The resilient portion 356 is formed of a lower durometer or more flexible material. In addition, the mounting head 348 has a resilient strip 358 extending between the attachment portion 352 and the blade mounting portion 354 through the resilient portion 356. The resilient strip 358 in a preferred embodiment is a piece of spring steel which is coextruded with the dual durometer plastic.

The blade mounting portion 354 has a configuration similar to that in the embodiment shown in FIG. 13. The blade mounting portion 354 forms a tip retaining channel and has a downward depending protrusion. The blade mounting portion has a pair of legs projecting into the channel.

The flexible contact blade 350 is the same as that disclosed in FIG. 13 and has a mounting portion 340' and an ink interaction portion 342'. Similar to the squeegees 274, 274', and 324 shown in FIGS. 12–14, respectively, the squeegee 326, has an ink interaction surface 360 on the mounting head 328 located above the flexible contact blade 330. The ink interaction surface 360 consists of portions of the attachment portions of 332, the resilient portion 336, and the blade mounting portion 334. The ink interaction surface 360 retains the ink in front of the flexible contact blade.

Figure 16:
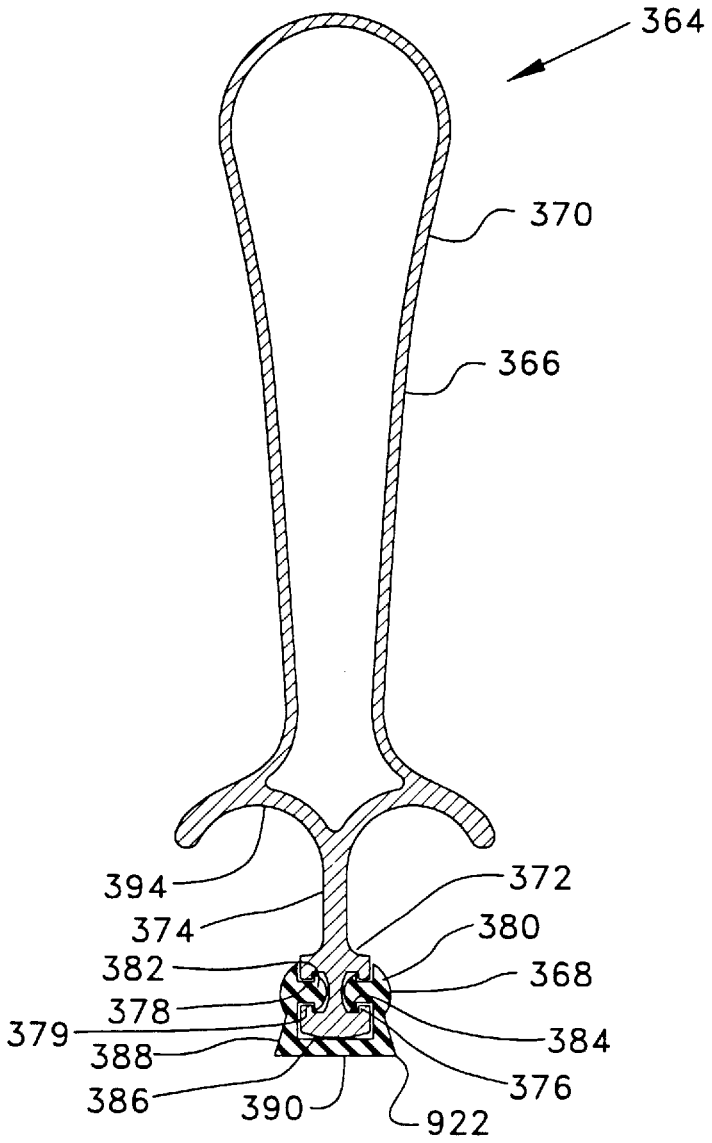
FIG. 16 is a cross-sectional view of an alternative embodiment of the squeegee for use with a manual screen printing.

Referring to FIG. 16, an alternative squeegee 364 for use in a manual printing operation according to the invention is shown. Squeegee 364 has a mounting head 366 and a flexible contact blade 368. The mounting head 366 in a preferred embodiment is formed of an extruded aluminum and has a handle portion 370, which acts as an attachment portion to the operator's hand, and a blade mounting portion 372. Between the handle portion 370 and the blade mounting portion 372 is a narrowed portion 374. The blade mounting portion 372 has a pair of tip retaining channels or grooves 376. The blade mounting portion 372 has a pair of legs 378 and 379 for projecting into each of the channels 376. While no resilient section is shown, it is recognized that the narrowed portion 374 could be formed to be resilient and flexible.

The flexible contact blade 368 of the squeegee 364 has a pair of mounting portions 380. Each mounting portion 380 has a tab 382 received by one of the tip root changing channels 376. The tab 382 has a neck portion 384 which is interposed between the legs 378 of the blade mounting portion 372 of the mounting head 366. The flexible contact blade 368 has an ink interaction portion 386 having a pair of side surfaces 388 and a bottom surface 390. The bottom surface 390 intersects with each of the side surfaces 388 to form an edge 392 at each intersection. Either edge 392 can interact with screen mesh 12.

Similar to the embodiment shown in FIGS. 12–15, the squeegee 364 has an ink interaction surface 394 on the mounting head 366 located above where the blade mounting portion 372 receives the flexible contact blade 368. The ink interaction surface 394 is formed of both the narrowed portion 374 and the concave curved portion of the handle portion 370 to reduce the likelihood that the operator will get ink on his or her hands during the squeegeeing process (since it places a rotation on the ink parallel to the direction of the squeegee). It is common with manual printing operations to use a single squeegee 364 as both a squeegee and a flood bar. The squeegee 364 is moved in one direction so as to place ink across and into the orifice of the screen. This is referred to as the flood stroke and is done with such a force on the squeegee 364 so as not to deflect the screen mesh into the substrate. Upon reaching the edge of the screen, the squeegee is moved in the opposite direction with sufficient force to deflect the mesh to pull the ink from the orifices onto the substrate.

Figure 17:
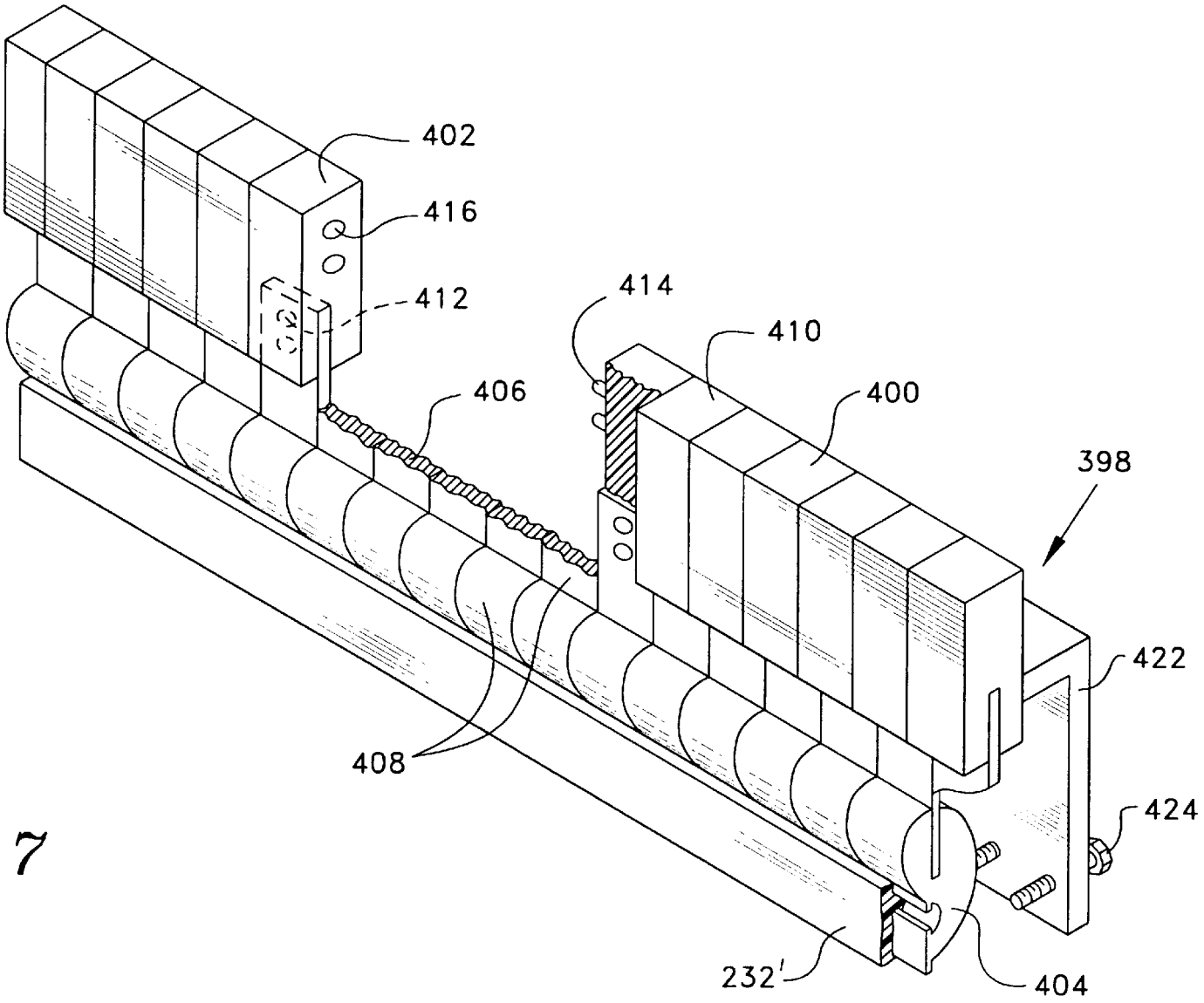
FIG. 17 is a perspective view of an alternate embodiment of the squeegee, with a portion of the mounting bracket broken away.
Figure 18:
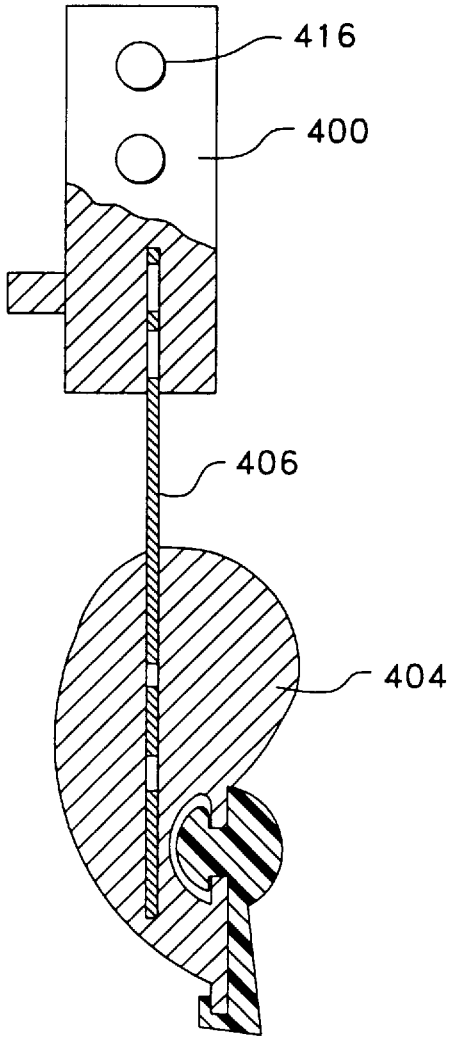
FIG. 18 is a cross-sectional view of this last embodiment of the squeegee.

Referring to FIGS. 17 and 18, an alternate embodiment of a squeegee 398 is shown. The squeegee 398 has a mounting head 400 and a flexible contact blade 232'. The mounting head 400, similar to that shown in FIGS. 10 and 11, has an attachment bracket 402, a blade mounting bracket 404, and a resilient strip 406. The blade mounting bracket 404 and the resilient strip 406 of the mounting head 400 are each divided into a plurality of segments 408. However, in contrast to the embodiment shown in FIGS. 10 and 11, the squeegee 398 shown in FIGS. 17 and 18 has the attachment bracket 402 divided into a plurality of segments 410.

In an preferred embodiment, the segments 410 of the attachment bracket 402 are each extruded with the resilient strip 406 retained via a pair of holes 412 in the resilient strip 406 receiving the extruded plastic. In addition, the attachment bracket 402 has a pair of pins 414 projecting from one end and a pair of holes 416 on the other end such that the segments 410 of the attachment bracket 402 can be joined together to form the squeegee 398 of the proper length. Each blade mounting bracket 404 (similar to several of the previous embodiments) has a tip retaining channel or groove 418, and a downward depending protrusion or tip 420. Each segment 408 of the blade mounting bracket 404 receives an associated segment 408 of the resilient strip 406.

In addition, the mounting head 400 has an L-shaped arm 422 which mounts to the attachment bracket 402 and depends downward in proximity to the blade mounting bracket 404. The depending arm has a plurality of adjustable fasteners 424 which project towards the blade mounting bracket 404. The amount of flexure in the blade mounting bracket 404 and the flexible contact blade 232' can be adjusted by adjusting the fastener 424 thereby varying the placement or movement of the blade mounting bracket 404.

The present invention may be embodied in other specific forms without departing from the spirit or essential attributes thereof and, accordingly, reference should be made to the appended claims, rather than to the foregoing specification, as indicating the scope of the invention.

I claim:

1. A squeegee for interacting with ink and a printing screen, comprising:

a mounting head having an attachment portion adapted to receive a force for moving the squeegee generally parallel to a plane defined by the printing screen;

a blade mount connected to the mounting head, the mounting head and blade mount being fabricated from a material which is resistant to molecular change caused by interaction with the ink, the blade mount having a female interlocking coupling mounted thereon, said female interlocking coupling comprising a pair of legs which define a locking groove, one of the legs defining an elongated backing plate; and a contact blade for engaging the printing screen and interacting with the ink, the contact blade having a male interlocking coupling and a backing face which is complementary with and conforms to the elongated backing plate, the male interlocking coupling comprising a necked tab protruding from the backing face and being detachably received in the locking groove.

2. The squeegee according to claim 1, wherein the contact blade further comprises a protrusion which extends from the backing face, the protrusion and a side of the necked tab form a channel for receiving the elongated backing plate.

3. The squeegee according to claim 1, wherein the face of the contact blade is coplanar with the backing plate.

4. The squeegee according to claim 1, wherein the contact blade extends past the blade mount and has a fixed cantilever length which is less than 25 percent of the length of the mounting head and blade mount.

5. The squeegee according to claim 4, wherein the mounting head further comprises a narrow strip portion which connects the attachment portion to the blade mount.

6. The squeegee according to claim 4, wherein the resilient portion and the blade mount are integral and the resilient portion and the blade mount are divided into two sections, the sections movable relative to each other between an open manufacturing position and a closed operational position.

7. The squeegee according to claim 6, further comprising a resilient strip interposed between the two sections of the resilient portion.

8. The squeegee in claim 7, wherein the blade mount further comprises a second locking groove, the contact blade further comprising a second necked tab adapted to be detachably received in the second locking groove, the second necked tab being detachably retained in the second locking groove.

9. The squeegee according to claim 6, further comprising a detent for securing the blade mount sections together in the closed operational position.

10. The squeegee according to claim 1, wherein the mounting head further comprising a resilient portion connecting the attachment portion and the blade mount, the resilient portion flexing relative to the force exerted on the attachment portion.

11. The squeegee according to claim 10, wherein the attachment portion, the resilient portion, and the blade mount are distinct elements.

12. The squeegee according to claim 1, wherein the contact blade further comprises a side surface and a bottom surface, the side surface and the bottom surface forming an edge adapted for interacting with the screen and the ink.

13. The squeegee according to claim 1, wherein the blade mount further comprises a second locking groove, the contact blade further comprising a second necked tab adapted to be detachably received in the second locking groove, the second necked tab being detachably retained in the second locking groove.

14. The squeegee according to claim 13, wherein the attachment portion, the narrow strip portion, and the blade mount are unitary.

15. The squeegee according to claim 1, wherein the blade mount is a unitary construction.

* * * * *